US008272089B1

(12) United States Patent
Stokes

(10) Patent No.: US 8,272,089 B1
(45) Date of Patent: Sep. 25, 2012

(54) MASSAGE TABLE ASSEMBLY

(76) Inventor: Ellen M. Stokes, Las Vegas, NV (US)

( * ) Notice: Subject to any disclaimer, the term of this patent is extended or adjusted under 35 U.S.C. 154(b) by 357 days.

(21) Appl. No.: 12/616,890

(22) Filed: Nov. 12, 2009

Related U.S. Application Data

(63) Continuation-in-part of application No. 12/200,216, filed on Aug. 28, 2008, now Pat. No. 7,636,967.

(51) Int. Cl.
*A47B 7/00* (2006.01)

(52) U.S. Cl. ..... 5/620; 5/622; 5/623; 5/735

(58) Field of Classification Search ..... 5/3, 620–623, 5/630–632, 417, 420, 694, 722, 723, 728–730, 5/735, 503.1, 658, 930
See application file for complete search history.

(56) References Cited

U.S. PATENT DOCUMENTS

| | | | | |
|---|---|---|---|---|
| 4,973,034 | A | 11/1990 | Michele | |
| 5,237,712 | A | 8/1993 | Ramsay | |
| D392,145 | S | 3/1998 | Thurston | |
| D403,772 | S | 1/1999 | Fanuzzi | |
| 6,049,926 | A | 4/2000 | Amaral | |
| 6,081,947 | A | 7/2000 | Disher | |
| 6,701,554 | B2 * | 3/2004 | Heimbrock | 5/623 |
| 6,922,859 | B2 * | 8/2005 | Gagnon et al. | 5/601 |
| 6,934,988 | B1 * | 8/2005 | Wetzler et al. | 5/621 |
| 7,127,764 | B1 | 10/2006 | Harding et al. | |
| 7,194,778 | B2 | 3/2007 | Riach | |
| 2006/0112490 | A1 | 6/2006 | Chausse | |

* cited by examiner

*Primary Examiner* — Robert G Santos
*Assistant Examiner* — Nicholas Polito

(57) ABSTRACT

A massage table assembly includes a tabletop with a top side, a bottom side, a first end, a second end, a first lateral edge and a second lateral edge. The tabletop has a primary aperture therein extending into the top side nearer to the first end than the second end. The primary aperture is elongated. Each of a plurality of insets is individually positionable in the primary aperture. The insets each have a pair of openings therein configured to receive breasts of a person lying face down on the tabletop. The openings extend into an upper surface and outwardly of a lower surface of each of the insets. Each of the insets has pairs of openings has different sizes with respect to other ones of the insets. A plurality of legs is attached to and extends downwardly from the bottom side.

6 Claims, 11 Drawing Sheets

MASSAGE TABLE ASSEMBLY

This application is a continuation in part of U.S. application Ser. No. 12/200,216 filed on Aug. 28, 2008 now U.S. Pat. No. 7,636,967.

BACKGROUND OF THE DISCLOSURE

Field of the Disclosure

The present invention relates to massage table devices and more particularly pertains to a new massage table device for providing access openings for a woman's breasts during a massage.

SUMMARY OF THE DISCLOSURE

An embodiment of the disclosure meets the needs presented above by generally comprising a tabletop that has a top side, a bottom side, a first end, a second end, a first lateral edge and a second lateral edge. The tabletop has a primary aperture therein extending into the top side and being positioned nearer to the first end than the second end. The primary aperture is elongated along a line orientated perpendicular to the first lateral edge. Each of a plurality of insets is individually positionable in the primary aperture. The insets each have a pair of openings therein configured to receive breasts of a person lying face down on the tabletop. The openings extend into an upper surface and outwardly of a lower surface of each of the insets. The openings of each the inset is aligned with each other along a line oriented perpendicular to the first lateral edge when an associated the inset is positioned in the primary aperture. Each opening of the pair of openings has a same size with respect to each other. Each of the insets has pairs of openings has different sizes with respect to other ones of the insets. A plurality of legs is attached to and extends downwardly from the bottom side.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
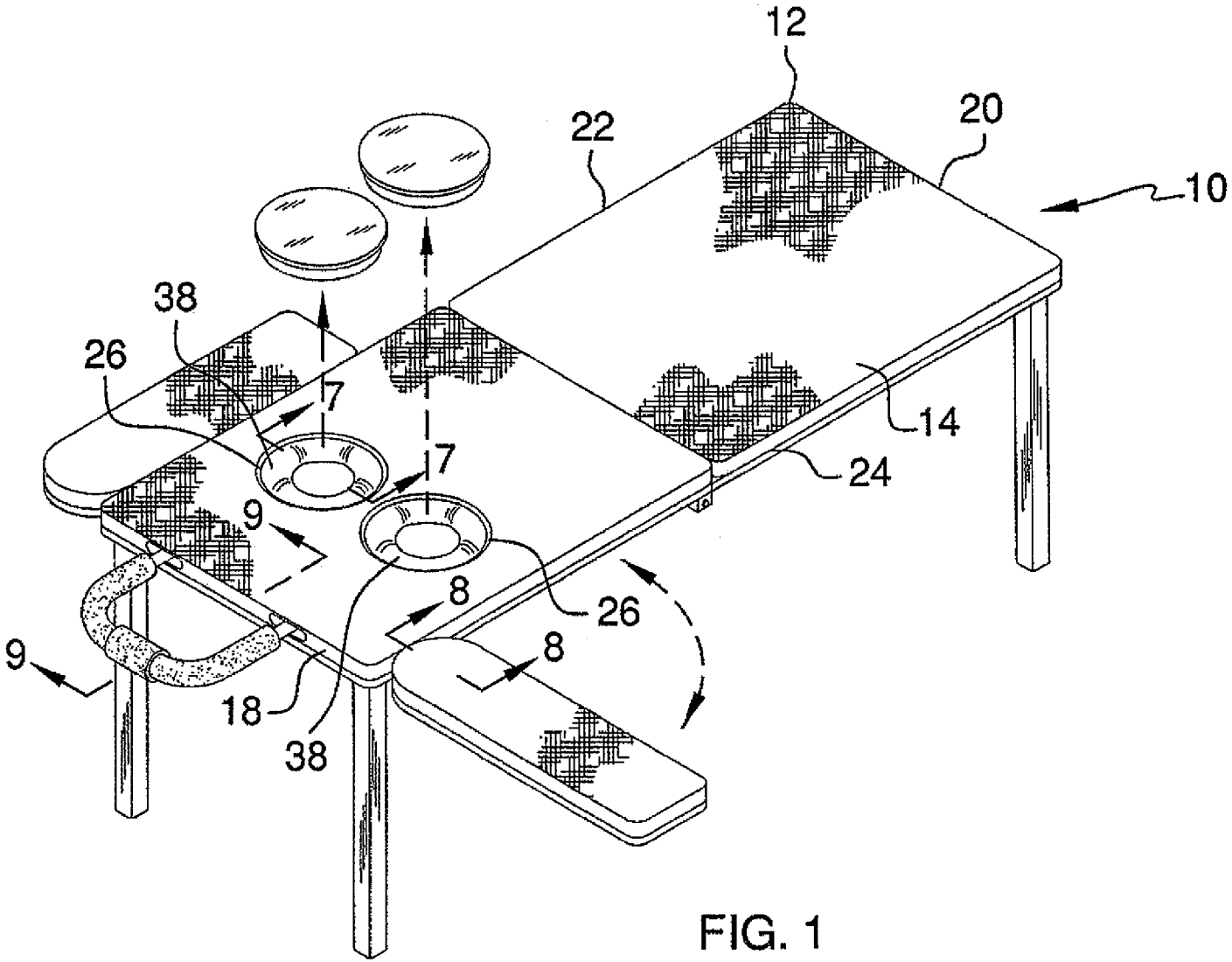
FIG. 1 is an expanded top perspective view of a massage table assembly according to the present invention.
Figure 2:
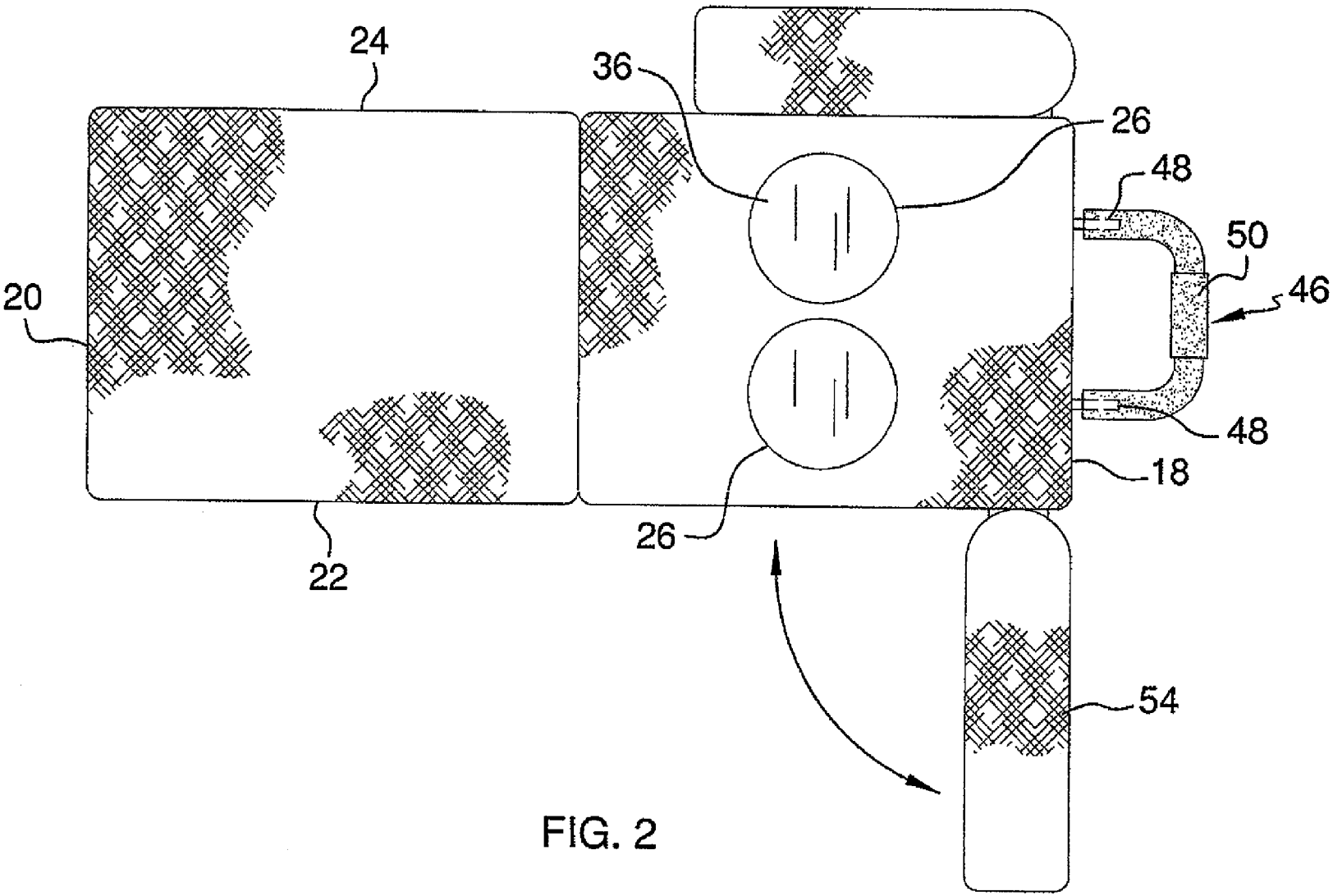
FIG. 2 is a top view of the present invention.
Figure 3:
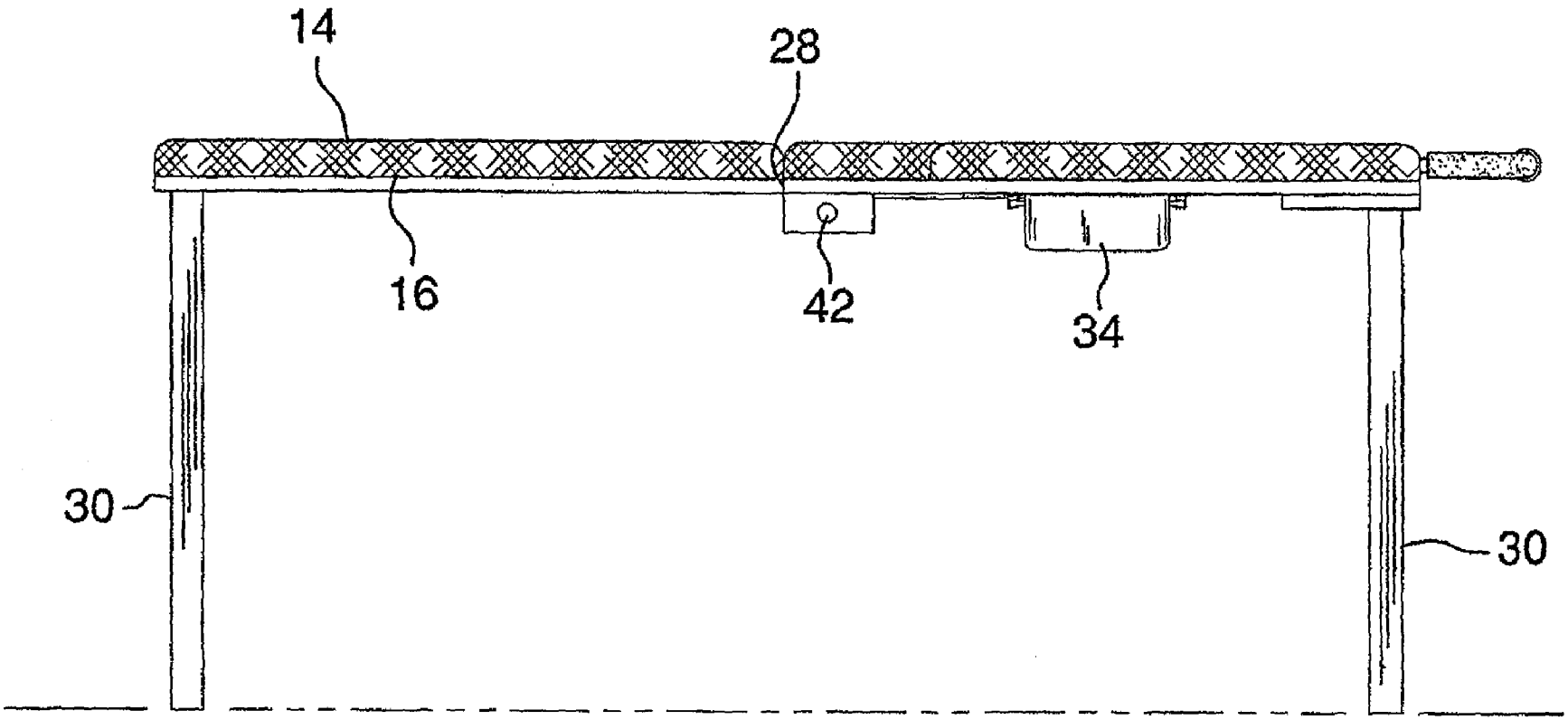
FIG. 3 is a right side view of the present invention.
Figure 4:
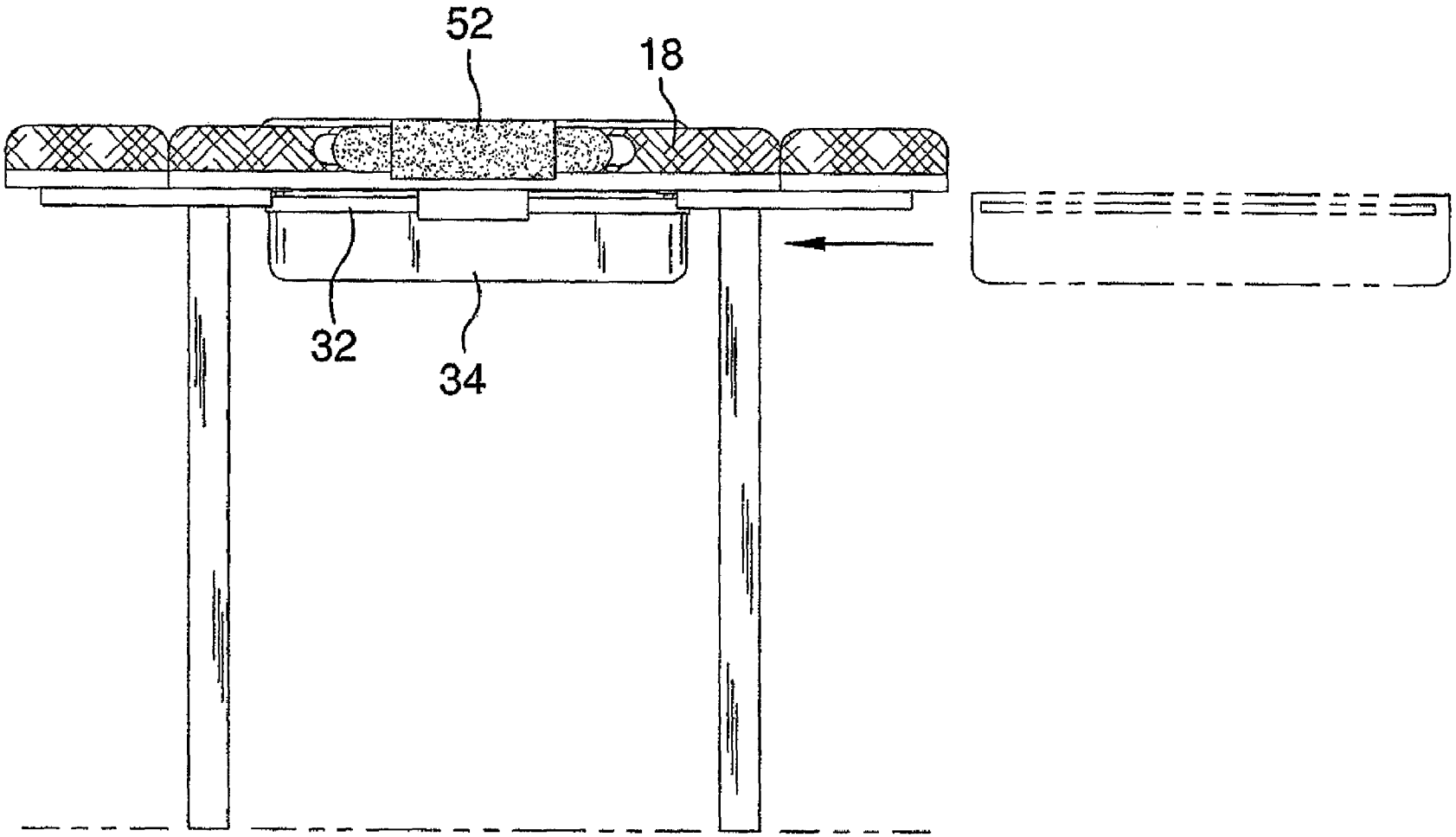
FIG. 4 is an end view of the present invention.
Figure 5:
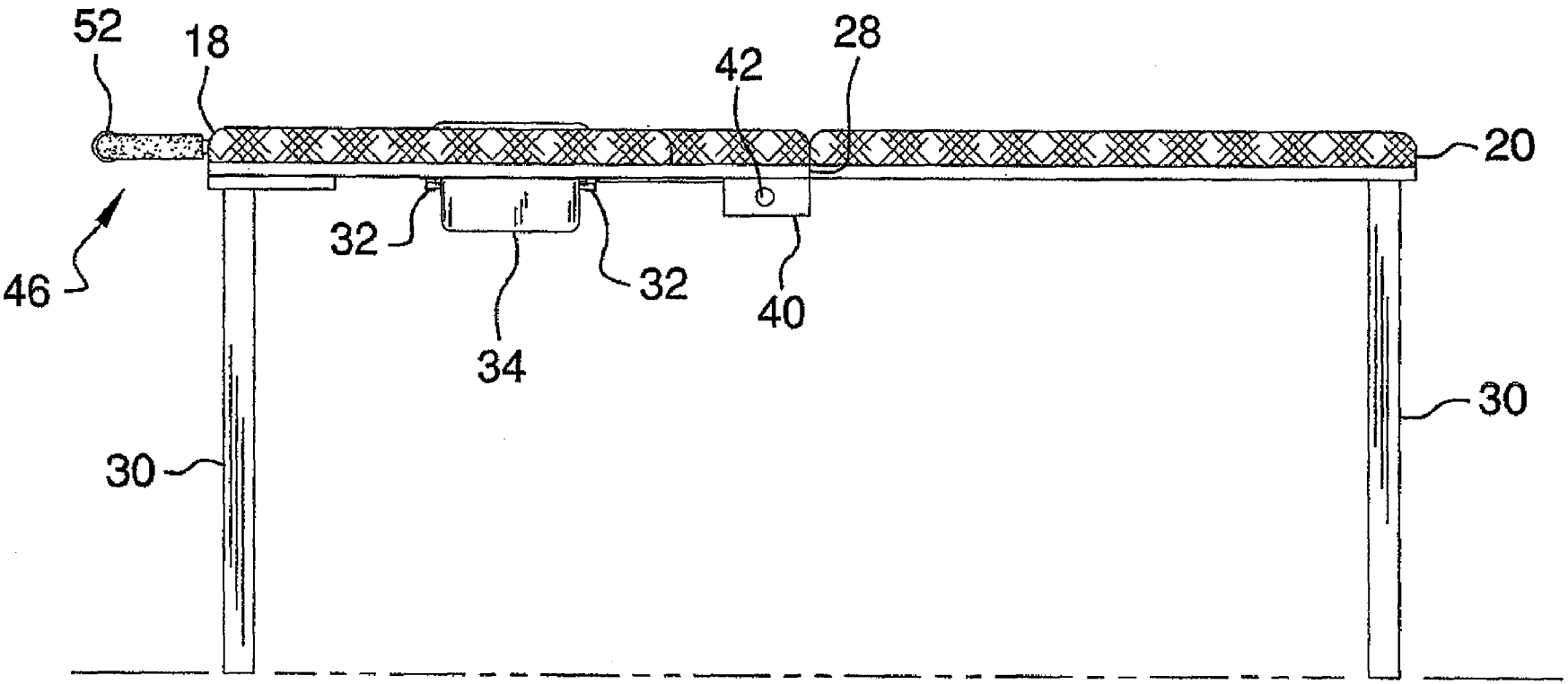
FIG. 5 is a left side view of the present invention.
Figure 6:
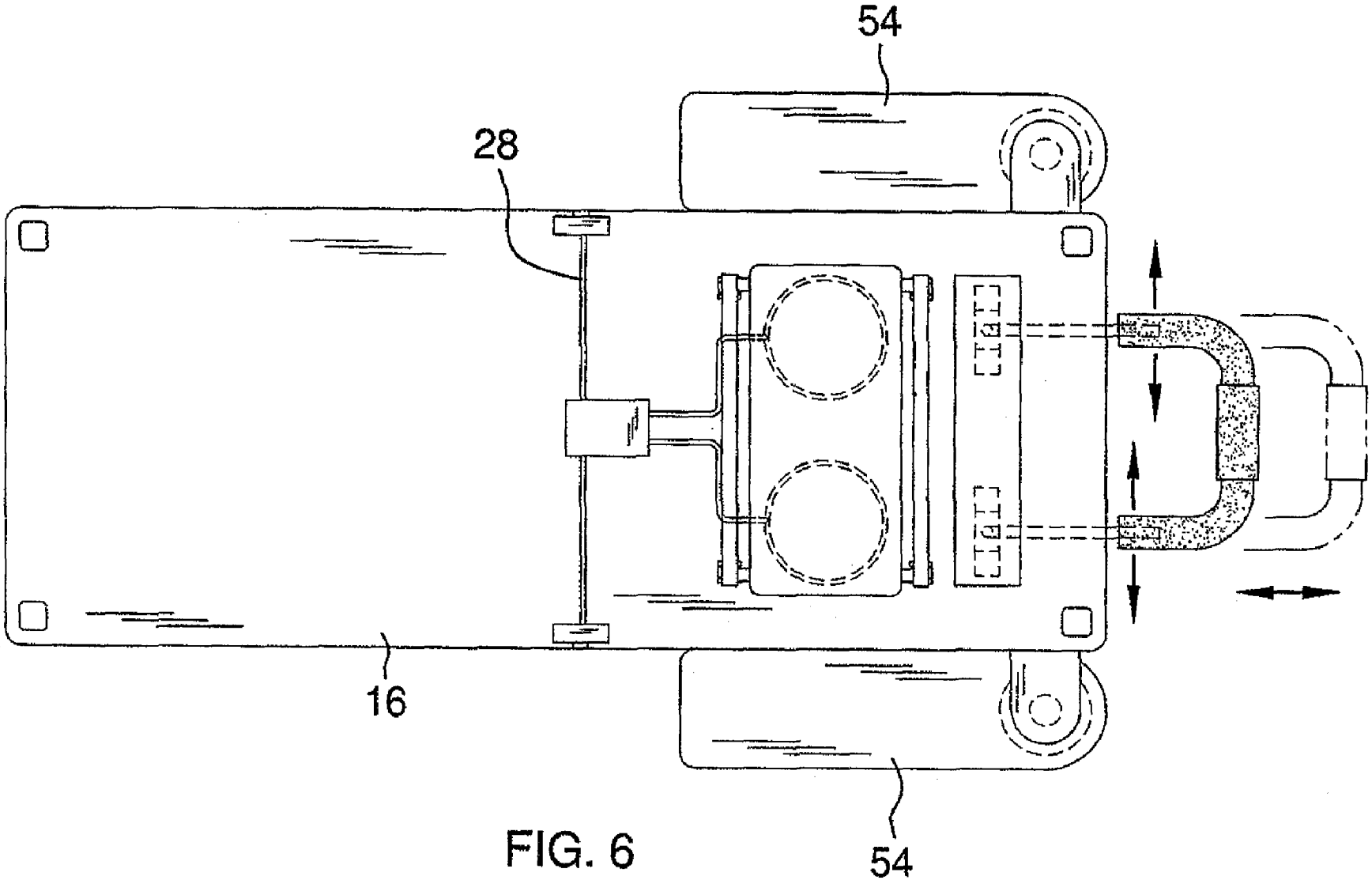
FIG. 6 is a bottom view of the present invention.
Figure 10:
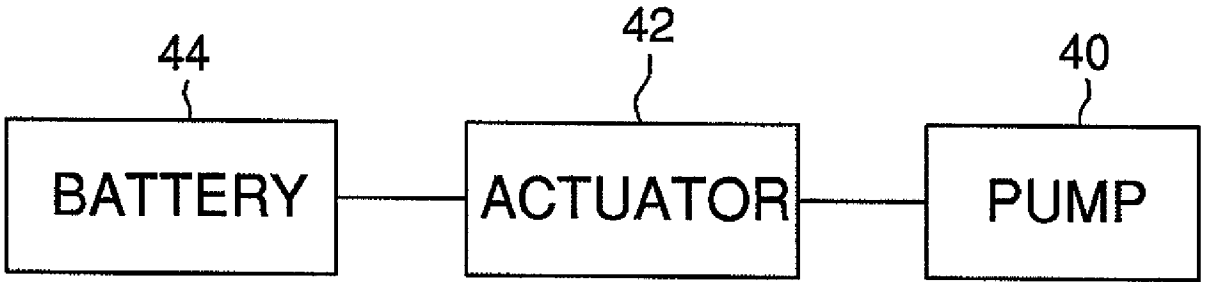
FIG. 10 is a schematic view of the present invention.
Figure 7B:
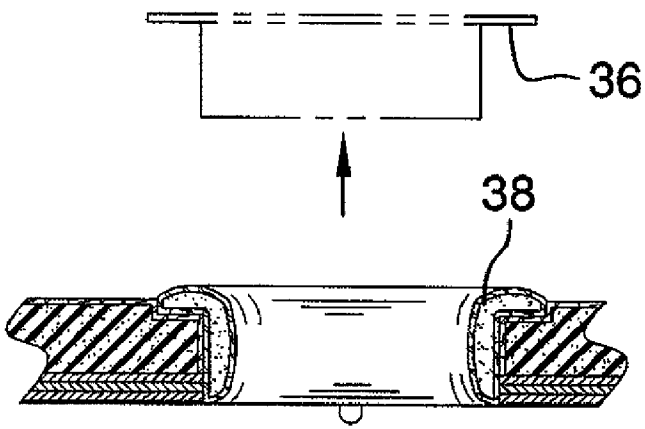
FIG. 7B is a cross-sectional view of the present invention taken along line 7-7 of FIG. 1 showing the insert removed and a bladder inflated.
Figure 7A:
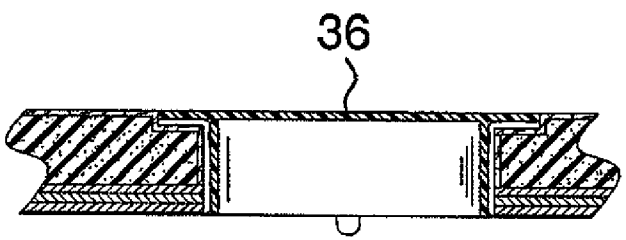
FIG. 7A is a cross-sectional view of the present invention taken along line 7-7 of FIG. 1 showing an insert in place.
Figure 8:
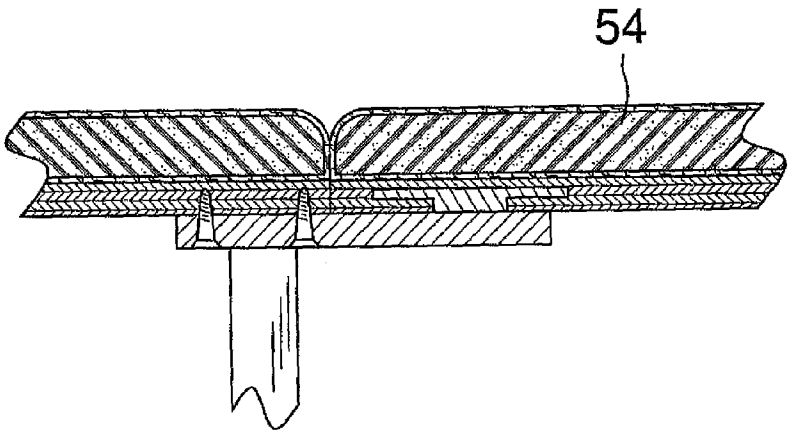
FIG. 8 is a cross-sectional view taken along line 8-8 of FIG. 1 of the present invention.
Figure 9:
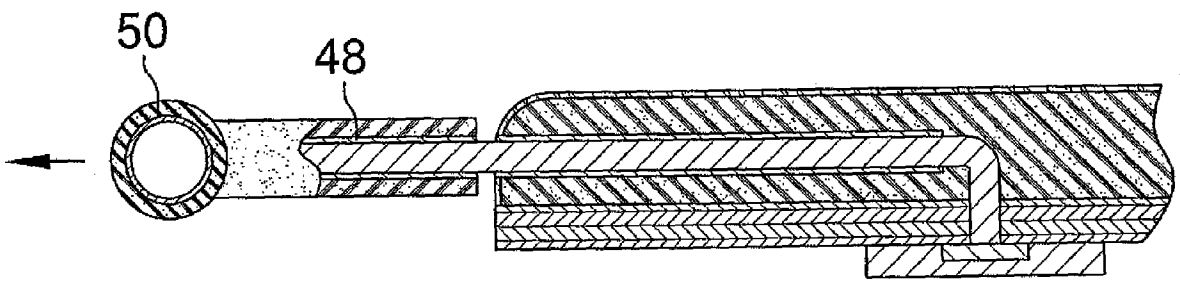
FIG. 9 is a cross-sectional view taken along line 9-9 of FIG. 1 of the present invention.

With reference now to the drawings, and in particular to FIGS. 1 through 13 thereof, a new massage table device embodying the principles and concepts of the present invention and generally designated by the reference numeral 10 will be described.

As best illustrated in FIGS. 1 through 13, the massage table assembly 10 generally comprises a tabletop 12 that has a top side 14, a bottom side 16, a first end 18, a second end 20, a first lateral edge 22 and a second lateral edge 24. The tabletop 12 has a pair of breast openings 26 therein configured to receive breasts of a person lying face down on the tabletop 12. The openings 26 are circular shaped and have a diameter between 5 inches and 10 inches. The openings 26 extend into the top side 14 and outwardly through the bottom side 16 and are aligned with each other along a line oriented perpendicular to the first lateral edge 22. The openings 26 are positioned nearer to the first end 18 than the second end 20. The tabletop 12 has a break 28 therein between the first 18 and second 20 ends to allow the tabletop 12 to be folded. A plurality of legs 30 is attached to and extends downwardly from the bottom side 16.

A guide 32 is attached to the bottom side 16 of the tabletop 12 nearer to the first end 18 than the second end 20. A container 34 is removably positioned on the guide 32 and is aligned with the openings 26 when container is placed on the guide 32 to cover breasts extending through the tabletop 12.

A pair of inserts 36 is provided. Each of the inserts 36 is removably positioned in one of the openings 26 to form a flush surface over the openings 26 with respect to an area adjacent to the openings 26. The inserts 34 are used when the openings 26 are not required, such as for a man or if the woman is lying on her back.

A pair of donut shaped bladders 38 is also provided. Each of the bladders 38 is attached to and extends around a perimeter edge of one of the openings 26. An air pump 40 is fluidly coupled to each of the bladders 38. The air pump 40 injects air into the bladders 38 when the air pump 40 is turned on to decrease a diameter of the openings 26 and to provide cushioning of the openings 26. The bladders 40 may extend upwardly over a plane of the top side 14 when filled with air. An actuator 42 is electrically coupled to the air pump 40 to turn the air pump on or off. A power source, such as a battery 44, is electrically coupled to the air pump 40 to supply power to the air pump 40.

A head support 46 is attached to and extends away from the first end 18 of the tabletop 12. The head support 46 is U-shaped and includes a pair of arms 48 and a central member 50 that is attached to and extends between the arms. The arms 48 are attached to the first end 18 and are spaced from each other a distance greater than 7 inches to prevent a face of a person lying on the table from contacting the arms 48 when a forehead of the person is resting on the central member 50. The arms 48 are slidably mounted in the tabletop 12 to allow adjusting of a distance between the central member 50 and the first end 18. A cushioning member 52 is positioned on the central member.

A pair of arm supports 54 is attached to the tabletop 12. Each of the first 22 and second 24 lateral edges has one of the arm supports 54 attached thereto. The arm supports 54 are pivotally coupled to the tabletop 12 and pivotable laterally from a corresponding one of the first 22 and second 24 lateral edges. The arm supports 54 remain coplanar with the tabletop 12 as the arm supports 54 are pivoted with respect to the tabletop 12.

In use, the tabletop 12 is used in a conventional manner to provide massages, however, the openings 26 in the tabletop 12 provide more comfort for a woman since the breasts will not by laid on during the massage. The bladders 38 provide support and cushioning for the breasts.

Figure 11:
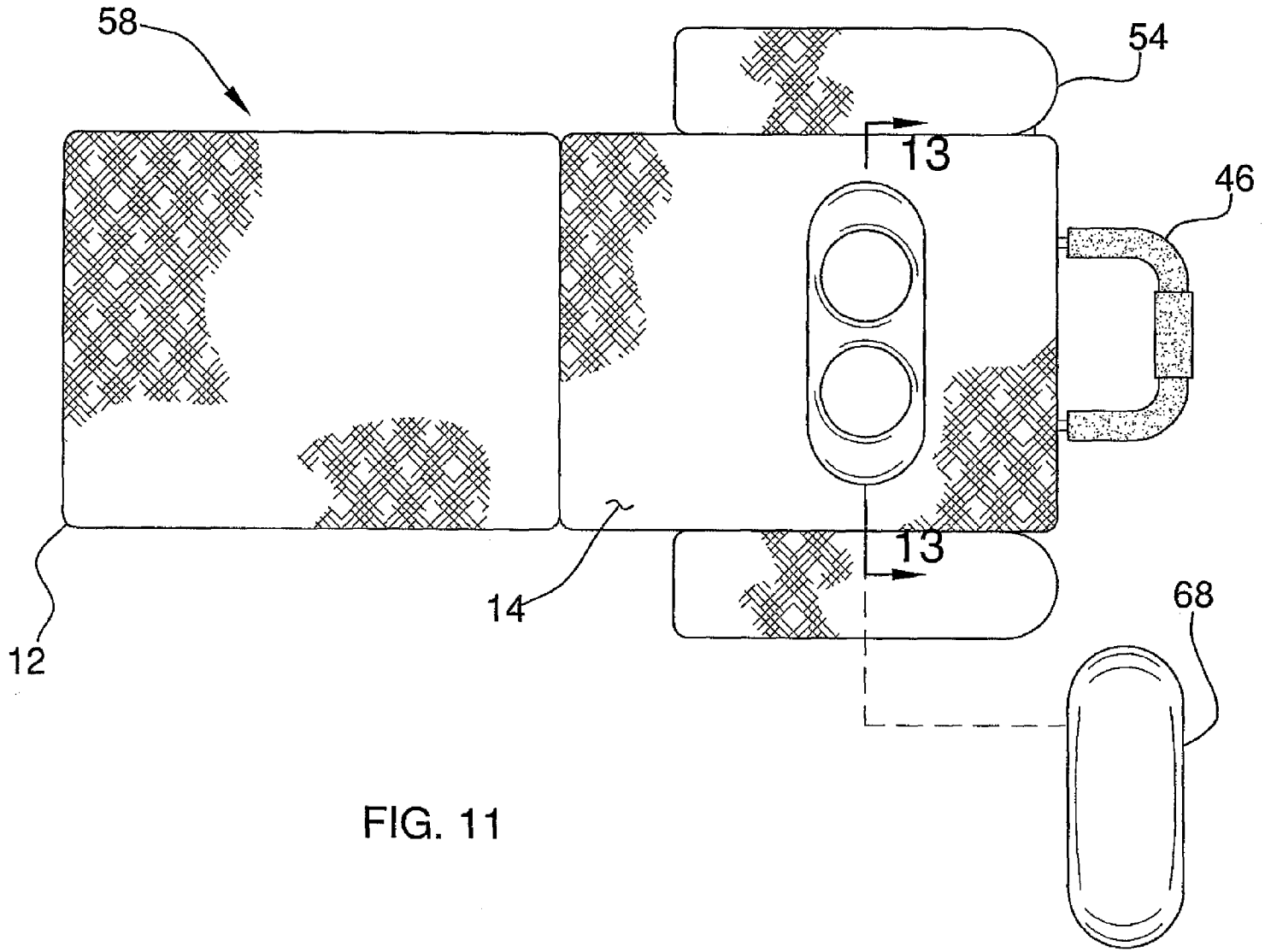
FIG. 11 is a top view of an embodiment of the present invention.
Figure 12:
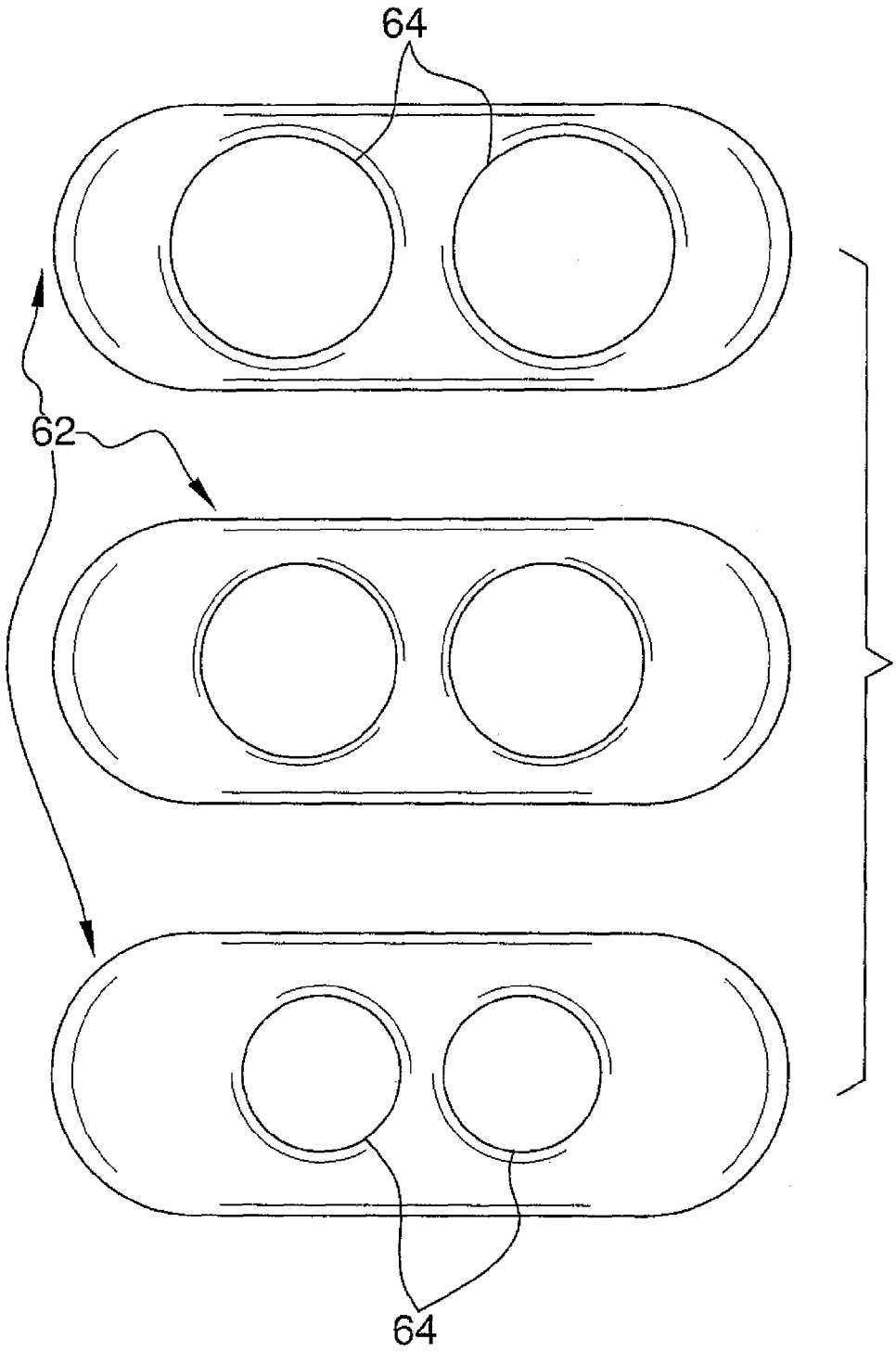
FIG. 12 is a top view of insets of present invention for an embodiment depicted in FIG. 11.
Figure 13:
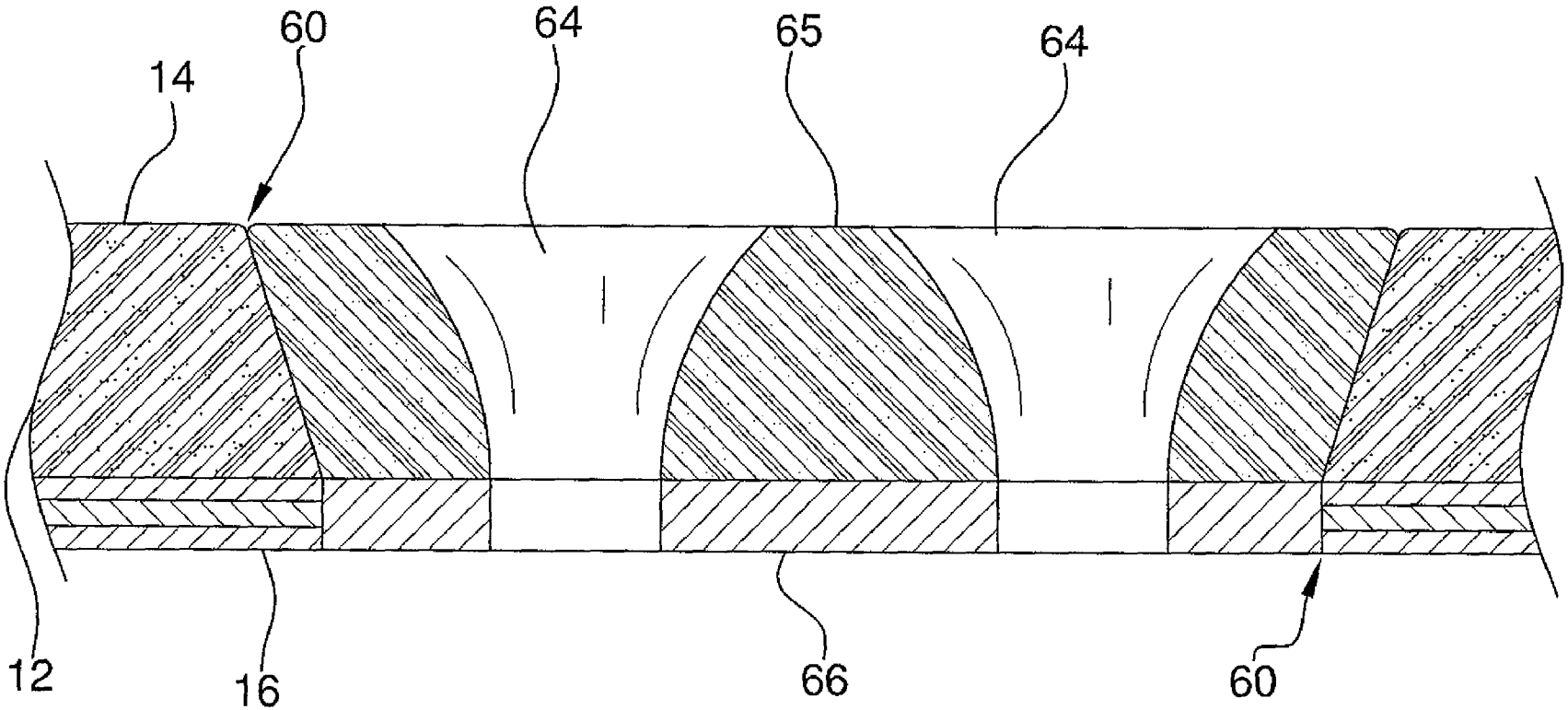
FIG. 13 is a cross-sectional view of the present invention taken along line 13-13 of FIG. 11.

In an embodiment 58 shown in FIGS. 11-13, instead of the tabletop 12 having openings 26 therein, the tabletop has a primary aperture 60 therein. The primary aperture 60 extends into the top side 14 and outwardly of the bottom side 16 and is positioned nearer to the first end 18 than the second end 20. The primary aperture 60 is elongated along a line orientated perpendicular to the first lateral edge 22. The tabletop 12 may again have a break 28 therein.

A plurality of insets 62 is provided. Each of the insets 62 is individually positionable in the primary aperture 60. The insets each have a pair of openings 64 therein, having a same size relative to each other, and configured to receive breasts of a person lying face down on the tabletop 12. The openings 64 extend into an upper surface 65 and outwardly of a lower surface 66 of each of the insets 62. The openings 64 of each the inset 62 are aligned with each other along a line oriented perpendicular to the first lateral edge 22 when an associated the inset 62 is positioned in the primary aperture 60. Each of the insets has pairs of openings 64 having different sizes with respect to other ones of the insets 62 to allow for variation in breast size. Additionally, the openings 64 of the insets 62 may be spaced different distances from each other to again accommodate women having different body widths. A primary insert 68 is removably positioned in one of the primary aperture 60 to form a flush surface over the primary aperture 60 with respect to an area adjacent to the primary aperture 60. The primary insert 68 has a same structure as the insets 62 but does not include the openings 64.

The remaining portion of this embodiment 58 is similar to the other embodiment 10 and will include legs 30 attached to the bottom side 16. A guide 32 may again be attached to the bottom side 16 of the tabletop nearer 12 to the first end 18 than the second end 20. This will allow a container 34 to again be removably positioned on the guide 32 to cover breasts extending through the tabletop 12. However, the primary aperture 60 need not extend through the bottom side 16 nor do the openings 64 need to extend through the lower surface 66. Also, the head support 46 and arm supports 54 may also be attached to the tabletop 16 as described above.

In use, the tabletop 12 is used in a conventional manner to provide massages, however, the openings insets 62 may be selected and used as needed to provided openings 64 in the tabletop 12 to accommodate a woman's breasts.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A massage table assembly comprising:

a tabletop having a top side, a bottom side, a first end, a second end, a first lateral edge and a second lateral edge, said tabletop having a primary aperture therein, said primary aperture extending into said top side and being positioned nearer to said first end than said second end, said primary aperture being elongated along a line orientated perpendicular to said first lateral edge;

a plurality of insets, each of said insets being individually positionable in said primary aperture, each of said insets having a pair of openings therein configured to receive breasts of a person lying face down on said tabletop, said openings extending into an upper surface of each of said insets, said openings of each said inset being aligned with each other along a line oriented perpendicular to said first lateral edge when an associated said inset is positioned in said primary aperture, each opening of said pair of openings having a same size with respect to each other, each of said insets having pairs of openings having different sizes with respect to other ones of said insets;

a plurality of legs being attached to and extending downwardly from said bottom side; and a guide being attached to said bottom side of said tabletop nearer to said first end than said second end; and a container being removably positioned on said guide and being aligned with said openings when container is placed on said guide to cover breasts extending through said tabletop.

2. The assembly according to claim 1, wherein said tabletop has a break therein between said first and second ends to allow said tabletop to be folded.

3. The assembly according to claim 1, wherein a primary insert is removably positioned in one of said primary aperture to form a flush surface over said primary aperture with respect to an area adjacent to said primary aperture.

4. The assembly according to claim 1, further including a head support being attached to and extending away from said first end of said tabletop, said head support being U-shaped and including a pair of arms and a central member being attached to and extending between said arms, said arms being attached to said first end, said arms being spaced from each other a distance greater than 7 inches to prevent a face of a person lying on said table from contacting the arms when a forehead of the person is resting on said central member, a cushioning member being positioned on said central member.

5. The assembly according to claim 1, further including a pair of arm supports being attached to said tabletop, each of said first and second lateral edges having one of said arm supports attached thereto, said arm supports being pivotally coupled to said tabletop and pivotable laterally from a corresponding one of said first and second lateral edges, said arm supports remaining coplanar with said tabletop as said arm supports are pivoted with respect to said tabletop.

6. A massage table assembly comprising:

a tabletop having a top side, a bottom side, a first end, a second end, a first lateral edge and a second lateral edge, said tabletop having a primary aperture therein, said primary aperture extending into said top side and outwardly of said bottom side and being positioned nearer to said first end than said second end, said primary aperture being elongated along a line orientated perpendicular to said first lateral edge, said tabletop having a break therein between said first and second ends to allow said tabletop to be folded;

a plurality of insets, each of said insets being individually positionable in said primary aperture, each of said insets having a pair of openings therein configured to receive breasts of a person lying face down on said tabletop, said openings extending into an upper surface and outwardly of a lower surface of each of said insets, said openings of each said inset being aligned with each other along a line oriented perpendicular to said first lateral edge when an associated said inset is positioned in said primary aperture, each opening of said pair of openings having a same size with respect to each other, each of said insets having pairs of openings having different sizes with respect to other ones of said insets;

a plurality of legs being attached to and extending downwardly from said bottom side;

a guide being attached to said bottom side of said tabletop nearer to said first end than said second end;

a container being removably positioned on said guide and being aligned with said openings when container is placed on said guide to cover breasts extending through said tabletop;

a primary insert being removably positioned in one of said primary aperture to form a flush surface over said primary aperture with respect to an area adjacent to said primary aperture;

a head support being attached to and extending away from said first end of said tabletop, said head support being U-shaped and including a pair of arms and a central member being attached to and extending between said arms, said arms being attached to said first end, said arms being spaced from each other a distance greater than 7 inches to prevent a face of a person lying on said table from contacting the arms when a forehead of the person is resting on said central member, a cushioning member being positioned on said central member; and a pair of arm supports being attached to said tabletop, each of said first and second lateral edges having one of said arm supports attached thereto, said arm supports being pivotally coupled to said tabletop and pivotable laterally from a corresponding one of said first and second lateral edges, said arm supports remaining coplanar with said tabletop as said arm supports are pivoted with respect to said tabletop.

* * * * *